US008414687B2

(12) United States Patent
Li

(10) Patent No.: US 8,414,687 B2
(45) Date of Patent: Apr. 9, 2013

(54) METHOD TO CONTROL PARTICULATE MATTER EMISSIONS

(75) Inventor: Dong X. Li, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 337 days.

(21) Appl. No.: 12/889,022

(22) Filed: Sep. 23, 2010

(65) Prior Publication Data

US 2012/0073436 A1 Mar. 29, 2012

(51) Int. Cl.
*B03C 3/76* (2006.01)
*B03C 3/80* (2006.01)

(52) U.S. Cl. ..... 95/74; 95/76; 95/78; 96/30; 96/31; 96/32; 96/43; 96/50; 96/60; 96/73

(58) Field of Classification Search ..... 95/74–76, 95/78; 96/30–38, 43, 50, 60, 73
See application file for complete search history.

(56) References Cited

U.S. PATENT DOCUMENTS

| | | | | | |
|---|---|---|---|---|---|
| 2,764,254 | A | * | 9/1956 | Klemperer | 96/25 |
| 3,365,858 | A | * | 1/1968 | Penney | 95/73 |
| 3,793,804 | A | | 2/1974 | Steuernagel | |
| 3,898,060 | A | * | 8/1975 | Starbuck | 96/31 |
| 3,900,299 | A | | 8/1975 | Spehrley | |
| 3,915,676 | A | | 10/1975 | Reed et al. | |
| 3,926,587 | A | | 12/1975 | Squires | |
| 3,984,216 | A | | 10/1976 | Smortchevsky | |
| 3,985,524 | A | | 10/1976 | Masuda | |
| 3,988,127 | A | * | 10/1976 | Schumann | 95/76 |
| 3,988,130 | A | | 10/1976 | Ramsey et al. | |
| 4,147,522 | A | | 4/1979 | Gonas et al. | |
| 4,178,156 | A | * | 12/1979 | Tashiro et al. | 95/59 |
| 4,218,225 | A | * | 8/1980 | Kirchhoff et al. | 96/32 |
| 4,481,017 | A | | 11/1984 | Furlong | |
| 4,713,092 | A | | 12/1987 | Kikuchi et al. | |
| 4,725,289 | A | | 2/1988 | Quintilian | |
| 5,039,318 | A | | 8/1991 | Johansson | |
| 5,183,480 | A | | 2/1993 | Raterman et al. | |
| 5,334,238 | A | | 8/1994 | Goodsen et al. | |
| 6,447,580 | B1 | * | 9/2002 | Ridgeway et al. | 96/30 |
| 6,736,878 | B2 | | 5/2004 | Hein | |

(Continued)

FOREIGN PATENT DOCUMENTS

| | | | |
|---|---|---|---|
| JP | 54-36674 | A * | 3/1979 |
| WO | 2008012923 | | 1/2008 |

OTHER PUBLICATIONS

PCT International Search Report, PCT/US2011/044464, mailed Mar. 16, 2012.

*Primary Examiner* — Richard L Chiesa
(74) *Attorney, Agent, or Firm* — Terrence Flaherty

(57) ABSTRACT

A method for removing particulate matter from a particulate-bearing gas stream includes flowing a particulate-bearing gas stream at a first volumetric flow rate to a plurality of ESP units; producing electrically charged particulate matter; collecting electrically charged particulate matter on collection electrode plates; reducing the flow through at least one of the ESP units; sequentially increasing the flow through one or more remaining ESP units in an amount so as to maintain the sum of flow through all of the ESP units at the first volumetric flow rate; subjecting the collection electrode plates in the at least one ESP unit with reduced flow to forces which dislodge the particulate matter from the collection electrode plates; collecting the dislodged particulate matter in a particulate collection receptacle; and withdrawing a gas stream of reduced particulate matter contamination.

10 Claims, 2 Drawing Sheets

U.S. PATENT DOCUMENTS

| | | | | |
|---|---|---|---|---|
| 7,156,902 | B1 | 1/2007 | Altman | |
| 7,294,169 | B2 * | 11/2007 | Taylor | 95/2 |
| 7,413,593 | B2 * | 8/2008 | Altman et al. | 95/2 |
| 7,641,718 | B2 | 1/2010 | Furuta et al. | |
| 7,901,489 | B2 * | 3/2011 | Jin et al. | 96/30 |
| 8,268,040 | B2 * | 9/2012 | Boyden et al. | 95/5 |
| 2006/0130657 | A1 * | 6/2006 | Bohlen et al. | 96/58 |
| 2007/0095207 | A1 * | 5/2007 | Tolvanen | 95/76 |
| 2009/0235821 | A1 | 9/2009 | Mochizuki et al. | |

* cited by examiner

METHOD TO CONTROL PARTICULATE MATTER EMISSIONS

TECHNICAL FIELD

The invention relates generally to methods for controlling particulate matter emissions by electrostatic precipitation.

BACKGROUND

Zeolite catalysts are employed in the fluid catalytic cracking (FCC) refining process to convert typically low value vacuum gas oils into distillates, primarily gasoline. Due to catalyst breakage and attrition during FCC conversion and regeneration, catalyst "fines" are created, which may have particle sizes of less than 10 microns in diameter, in the catalyst inventory. These particulates are very easily entrained in any gas. Because it is undesirable to permit these particulates to pass into the atmosphere in the flue gases, electrostatic precipitators (ESP) have been employed as a means of trapping such particulates before release into the atmosphere.

The most common ESP in industrial applications is a plate-wire ESP, where gas flows between positively charged metal plates and negatively charged electrode wires. A high voltage applied between the plate and wire causes an electrically charged corona to form in the gas between the plate and the wire. An alternative to the plate-wire ESP is a flat plate ESP, where corona generating wires, or discharge electrodes, are placed ahead of collection plates. During operation of the ESP, a particulate-bearing gas passes through negatively charged corona and the particulates themselves become negatively charged. The charged particulates are then carried in the flowing gas stream to positively charged collection plates that are positioned parallel to the direction of the gas flow. The particulates accumulate on the collection plates and are removed by various techniques for disposal.

One problem associated with electrostatic precipitators is the re-entrainment of particulates in the flue gas when they are dislodged from collecting plates, typically by the application of a mechanical displacing force, or "rapping." The particle re-entrainment during rapping, often referred to as "rapping puff" accounts for a majority of particulate matters (PM) escaping the ESP with the flue gas. It has been proposed that, in order to minimize re-entrainment, the collecting surface should be struck by a force of proper intensity to snap the dust cake formed on the collecting electrode loose and allow it to slide down in cake form into a dust hopper from which it can be collected. Methods have also been proposed to further minimize re-entrainment by adding baffles to collecting electrode plates or by employing jets of secondary gas (see, for example, U.S. Pat. No. 3,988,130) in order to keep the bulk of the flue gas away from the dust cake, thereby providing a quiescent zone for dust to slide downward during rapping. It has also been proposed to stop or reverse gas flow through a portion of a precipitator during rapping (see, for example, U.S. Pat. No. 3,900,299). However, these approaches will not be effective for a large industry ESP because of long settling time required for fine particles with a low terminal velocity.

As finer and finer particulates are being regulated (EPA PM10 and PM2.5 regulations), re-entrainment of micron and submicron sized particulates is becoming more problematic. A need exists for novel methods for controlling fine particulate matter emissions.

SUMMARY OF THE INVENTION

In one embodiment, the invention relates to a method for removing particulate matter from a particulate-bearing gas stream comprising: flowing a particulate-bearing gas stream in a first direction at a first volumetric flow rate to a plurality of electrostatic precipitator units; passing at least a portion of the gas stream past at least one discharge electrode in each electrostatic precipitator so as to produce electrically charged particulate matter; collecting the electrically charged particulate matter on at least one primary collection electrode plate, which is oppositely charged from the discharge electrode, until a desired amount of particulate matter has been collected; reducing the flow through at least one of the electrostatic precipitator units; sequentially increasing the flow through one or more remaining electrostatic precipitator units in an amount so as to maintain the sum of flow through all of the electrostatic precipitator units at the first volumetric flow rate; subjecting the at least one primary collection electrode plate in the at least one electrostatic precipitator unit with reduced flow to forces which dislodge the particulate matter from the at least one primary collection electrode; collecting the dislodged particulate matter in a particulate collection receptacle; and withdrawing a gas stream of reduced particulate matter contamination.

BRIEF DESCRIPTION OF THE DRAWINGS

For a more complete understanding of the invention, and the advantages thereof, reference is now made to the following descriptions taken in conjunction with the accompanying drawings, in which.

DETAILED DESCRIPTION

Figure 1:
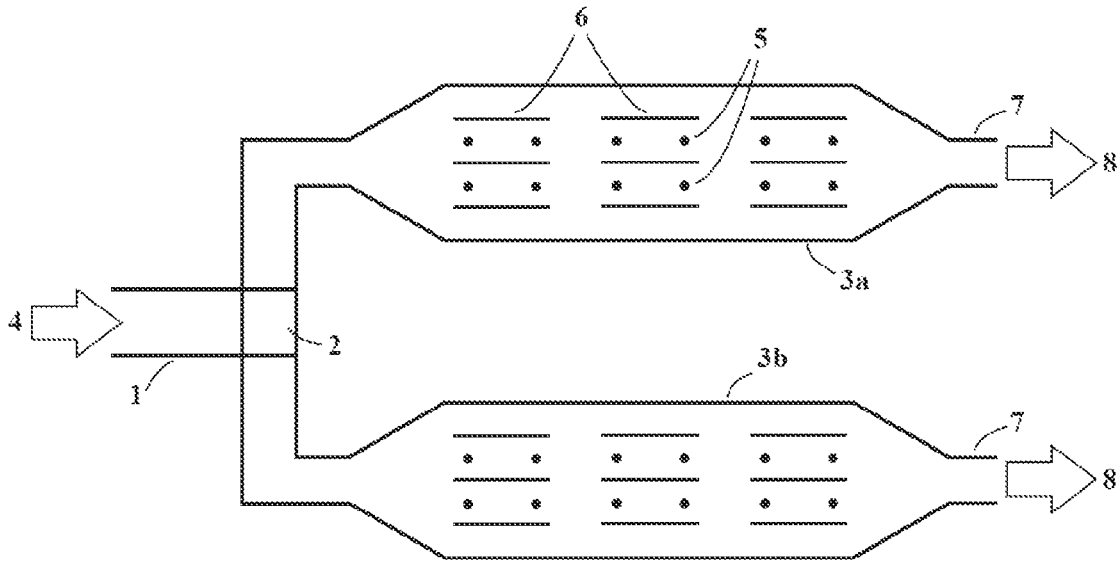
FIG. 1 is a top-view of a plurality of ESP units arranged in a parallel flow processing scheme.

In one embodiment, the invention relates to a method for removing particulate matter from a particulate-bearing gas stream comprising: flowing a particulate-bearing gas stream in a first direction at a first volumetric flow rate to a plurality of electrostatic precipitator units; passing at least a portion of the gas stream past at least one discharge electrode in each electrostatic precipitator so as to produce electrically charged particulate matter; collecting the electrically charged particulate matter on at least one primary collection electrode plate, which is oppositely charged from the discharge electrode, until a desired amount of particulate matter has been collected; reducing the flow through at least one of the electrostatic precipitator units; sequentially increasing the flow through one or more remaining electrostatic precipitator units in an amount so as to maintain the sum of flow through all of the electrostatic precipitator units at the first volumetric flow rate; subjecting the at least one primary collection electrode plate in the at least one electrostatic precipitator unit with reduced flow to forces which dislodge the particulate matter from the at least one primary collection electrode; collecting the dislodged particulate matter in a particulate collection receptacle; and withdrawing a gas stream of reduced particulate matter contamination.

The particulate-bearing gas stream to which the process can be suitably applied is any gaseous stream that contains solid or liquid particles that can be given an electrical charge. The gas stream include, but are not limited to one or more of oxygen, nitrogen, carbon monoxide, carbon dioxide, nitrogen oxides, sulfur oxides, ammonia and hydrocarbon gases. Exemplary gas streams include air streams vented from a dusty environment, from a manufacturing process, from a mining process, from a solids-handling process. In one embodiment, the gas stream is a flue gas derived from a combustion process, particularly processes in which solids such as coal, wood, tires or other waste materials and garbage, are combusted. In one embodiment, the gas stream is exhaust gas from an engine, such as a diesel engine or a gas turbine. In one embodiment, the gas stream is an effluent from one or more stages of a fluidized catalytic cracking process (FCC) which contains catalyst fines. More particularly, such effluent can be hydrocarbon-containing gas containing catalyst fines which should be removed before passage to a fractionation stage. Alternatively, such effluent can be flue gas from the regenerator which should be treated to remove particulates such as catalyst fines prior to exhausting to the atmosphere.

The particulate-bearing gas stream contains solid or liquid particulate matter suspended in the gaseous components. The particulate matter in the gas stream is of a size, shape and density to be entrained in the gas stream at the temperature, pressure and velocity of the gas stream. Exemplary solid particulate matter includes catalyst particles, coal, coke or other carbon based particles, organic particles, and inorganic particles such as oxides or sulfides of metals, including aluminum and silicon. In one embodiment, the particulate matter is primarily zeolite catalyst particles from the regeneration section of a fluid catalytic cracking unit in a petroleum refinery.

In one embodiment, at least 70% by weight of the particulate matter has a particle size of less than 100 microns in diameter. In one embodiment, at least 70% by weight of the particulate matter has a particle size of less than 50 microns in diameter. In one embodiment, at least 70% by weight of the particulate matter has a particle size of less than 25 microns in diameter. In one embodiment, at least 70% by weight of the particulate matter has a particle size of less than 10 microns in diameter. In one embodiment, at least 70% by weight of the particulate matter has a particle size of less than 5 microns in diameter. In one embodiment, at least 70% by weight of the particulate matter has a particle size of less than 2.5 microns in diameter.

Exemplary temperatures for the particulate-bearing gas stream include a temperature in the range from 20°-1000° C., or in the range of 100°-800° C., or in the range of 200°-600° C. Prior to the treatment process for removing at least a portion of the particles from the particulate-bearing gas stream, the gas stream may be heated, or cooled, to the desired temperature of the gas as it passes through the separation unit. The pressure of the particulate-bearing gas stream may suitably be any pressure at which the particulate matter can be removed from the gas stream, such as, for example, a pressure in the range of atmospheric pressure to 1000 psig. In one embodiment, the pressure is in the range from atmospheric pressure to 100 psig. In some such embodiments, the pressure is in the range of from atmospheric pressure to 50 psig, or from atmospheric pressure to 25 psig, or from atmospheric pressure to 14 psig or from atmospheric pressure to 10 psig. Prior to the treatment process for removing at least a portion of the particulate matter from the particulate-bearing gas stream, the pressure of the gas stream may be increased or decreased to the desired pressure of the gas as it passes through the separation unit.

Figure 2:
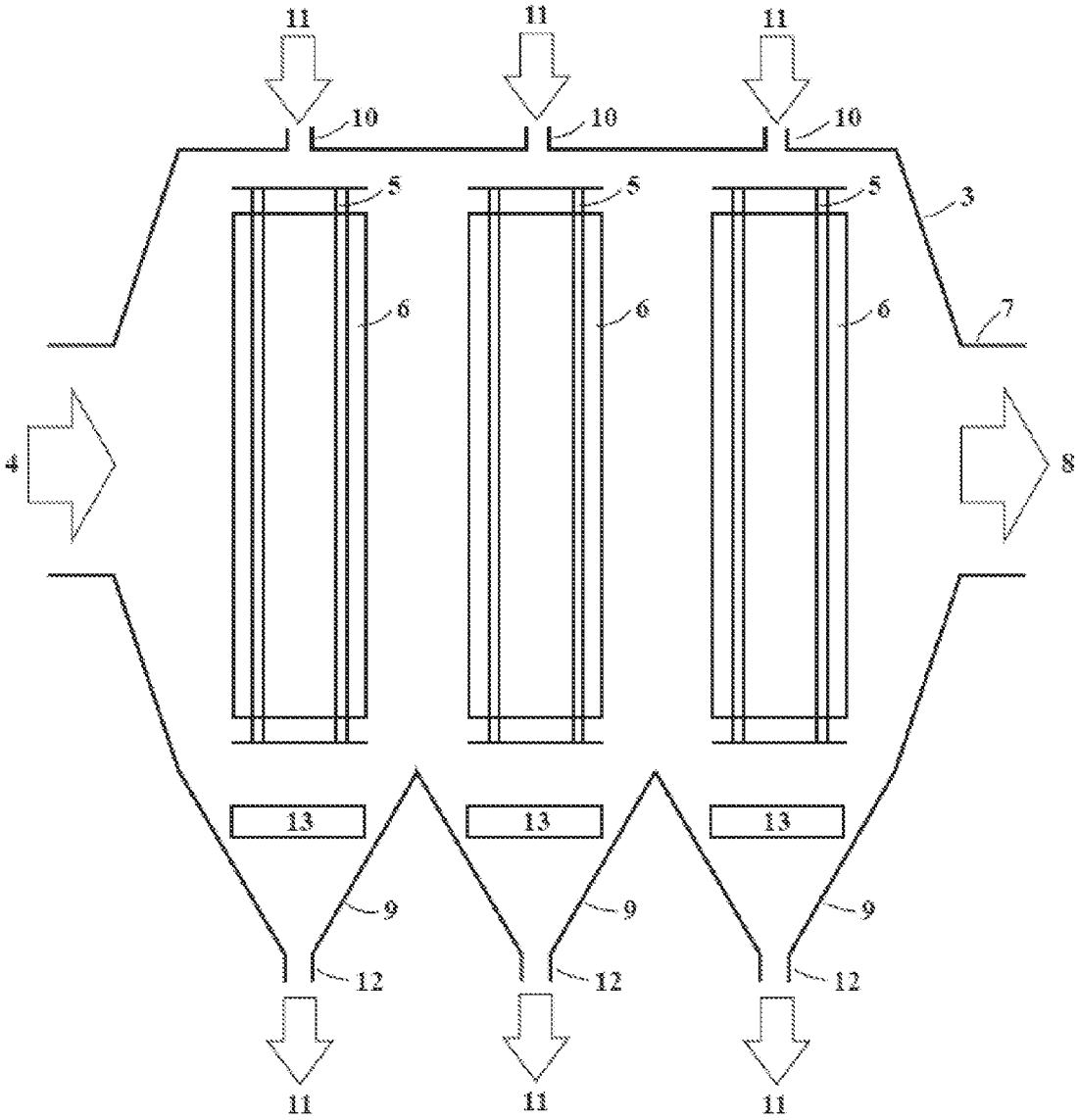
FIG. 2 is a cross-sectional view of an ESP unit which includes a secondary collection electrode positioned within the particulate collecting receptacle.

In some such above-described method embodiments and with respect to FIG. 1 and FIG. 2, a particulate-bearing gas stream 4 is flowed in a first direction at a first volumetric flow rate to a plurality of electrostatic precipitator units (3*a*, 3*b*). The particulate-containing gas stream 4 is introduced to the apparatus via a gas inlet 1 and a gas stream 8 of reduced particulate matter contamination is removed via a gas outlet 7 after treatment. A flow splitter 2 divides the gas stream 4 into a plurality of streams and the flow rate of each stream can be independently controlled. Each ESP unit may be designed to handle the same process gas flow rate as the others. The ESP unit can include a means capable of forcing the gaseous stream from a gas inlet to a gas outlet, e.g. a compressor or blower. Disposed downstream of the gas inlet 1 (or upstream of the gas inlet in the case of two-stage precipitators) are discharge electrodes 5 which serve to effect gas ionization and induce particulate charging. Primary collection electrode plates 6, which are oppositely charged from the discharge electrodes, attract or hold charged particulate matter. An embodiment shown in FIG. 1 illustrates two ESP units (3*a*, 3*b*) wherein the collecting electrode plates are arranged in a parallel flow processing scheme, though any number of ESP units could be managed in the process.

Alternatively, one or more of the plurality of ESP units may be designed to handle a different specified flow rate of the particulate-bearing gas stream to achieve a desired particulate matter removal rate. The design flow rate of the particulate-bearing gas stream in each ESP unit may be controlled via the flow splitter 2.

In some such above-described method embodiments, at least a portion of the particulate-bearing gas stream 4 is passed by at least one discharge electrode 5 in each electrostatic precipitator so as to produce electrically charged particulate matter. A conventional voltage source (not shown) is employed to apply a voltage to the discharge electrodes 5 and the primary collection electrode plates 6. The discharge electrodes 5 and the primary collection electrode plates 6 are preferably negative polarity discharge (gas ionizing) electrodes because higher voltages which improve efficiency can be obtained without sparkover. However, the electrodes can be positive polarity discharge electrodes which avoid the formation of ozone in oxygen-containing gases encountered during use of negative polarity discharge electrodes.

In some such above-described method embodiments, the flow of the particulate-bearing gas stream 4 is reduced through at least one electrostatic precipitator unit. The flow of the particulate-bearing gas stream through the inlet conduit 1 to each ESP unit may be modulated by the flow splitter 2. Such a flow control device can control the flow of the fluid stream, ranging from a flow at the design rate to no flow through the ESP unit. In one embodiment, the flow of the particulate-bearing gas stream through at least one electrostatic precipitator unit is reduced by at least 5 vol. %. In one embodiment, the flow of the particulate-bearing gas stream through at least one electrostatic precipitator unit is reduced by at least 25 vol. %. In one embodiment, the flow of the particulate-bearing gas stream through at least one electrostatic precipitator unit is reduced by at least 50 vol. %. In one embodiment, the flow of the particulate-bearing gas stream through at least one electrostatic precipitator unit is reduced by at least 90 vol. %. In one embodiment, the flow of the particulate-bearing gas stream through at least one electrostatic precipitator unit is reduced by 100 vol. %, i.e., there is no flow of the particulate-bearing stream 4 through at least one electrostatic precipitator unit. Reduction of the flow of the particulate-bearing stream is desirable in order to reduce re-entrainment of the charged particulate matter once the particulate matter has been dislodged from the primary collection electrode plates 6.

In some such above-described method embodiments and with respect to FIG. 2, the at least one primary collection electrode plate 6 in the first electrostatic precipitator with reduced flow is subjected to forces which detach the particulate matter from the at least one primary collection electrode plate 6. In order to effect removal of particulate matter from the primary particulate collection electrode plates 6, the collection plates can be struck by a force of proper intensity to dislodge the built-up particulate matter loose therefrom, allowing the dislodged particulate matter to be dropped by gravity into the particulate collection receptacle 9, e.g. a hopper, from which it can be removed continually or periodically. The force employed can be of any type suitable to effect the desired dislocation of particulate matter from the collecting surface, the simplest of which is mechanical, i.e., "rapping" the collector surface. Alternatively, the collecting surface can be exposed to blasts of sonic or ultrasonic energy to effect such dislocation. Where the particulate matter retains economic value, for example, as a catalyst, it can be recycled from the particulate collection receptacle to a catalyst regenerator. Otherwise such particulate matter can be disposed of by conventional techniques.

In some such above-described method embodiments, the flow through one or more remaining electrostatic precipitator units is increased in an amount so as to maintain the sum of flow through all of the electrostatic precipitator units at the first volumetric flow rate. For example, as the flow of the particulate-bearing gas stream through an electrostatic precipitator unit is reduced by 5 vol. %, the flow of the particulate-bearing gas stream is sequentially increased through the one or more remaining electrostatic precipitator units so as to maintain the sum of flow through all of the electrostatic precipitator units at the first volumetric flow rate. This flow rate oscillation can be accomplished with a slow rotating baffle at the flow splitter 2 that matches the rapping frequency. The rotating baffle directs less flow to an ESP unit during rapping while maintaining steady overall flow throughout the system.

In one embodiment and with respect to FIG. 1 and FIG. 2, such above-described methods further comprise flowing a secondary gas stream 11 in a second direction to drive the particulate matter that is dislodged from the at least one primary collection electrode plate 6 to the particulate collection receptacle 9. In this embodiment, a quiescent zone is first established in the ESP unit 3 wherein the flow of the particulate-bearing gas stream 4 is interrupted or at least significantly reduced. In one embodiment, the flow of the particulate-bearing gas stream 4 in the quiescent zone has been reduced by at least 90%; in one embodiment, by at least 95%. The typical flow through the ESP resembles plug flow where the entire particulate-bearing gas stream 4 is travelling at generally the same speed through the unit towards the gas outlet 7. However, in the quiescent zone, the particulate-bearing gas stream 4 does not significantly advance towards the gas outlet 7. In one embodiment, the secondary gas stream 11 is flowed in a direction oblique to the flow direction of the particulate-bearing gas stream 4. The secondary gas stream 11 may be directed by a means capable of forcing the secondary gas stream 11 from a secondary gas inlet 10 gas inlet to a secondary gas outlet 12 such as a compressor or blower. The secondary gas stream 11 is of sufficient flow to drive the particulate matter that is dislodged from the at least one primary collection electrode plate 6 to the particulate collection receptacle 9. Too strong a flow of the secondary gas stream may lead to uncontrolled blow-back from the gas flowing through the ESP unit. The secondary gas stream 11 may be recycled back to the ESP inlet 1 or filtered in a little bag house (not shown). Suitable secondary gases include, but are not limited to, air, one or more of oxygen, nitrogen, carbon monoxide, carbon dioxide and hydrocarbon gases.

In one embodiment and with reference to FIG. 2, such above-described methods further comprise generating an electrical potential between the at least one primary collection electrode plate 6 and the particulate collection receptacle 9 to drive the particulate matter that is dislodged from the at least one primary collection electrode plate 6 to the particulate collection receptacle 9. In one embodiment, the electrical potential is generated in the particulate collecting receptacle 9 with a polarity that is equal to the polarity of the at least one primary collection electrode plate 6, and the polarity of the at least one primary collection electrode plate 6 is reversed, such that the polarity of the at least one primary collection electrode plate 6 is opposite in polarity to that of an electrical charge generated in the particulate collecting receptacle 9. A conventional voltage source (not shown) is employed to apply the electrical potential. In one embodiment, the electrical charge in the particulate collecting receptacle 9 is generated by means of a secondary collection electrode 13. The secondary collection electrode 13 may be a wire, a plate or a grid. Particulate matter adhered to the secondary collection electrode 13 may be dislodged by conventional means such as described previously.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. To an extent not inconsistent herewith, all citations' referred to herein are hereby incorporated by reference.

The invention claimed is:

1. A method for removing particulate matter from a particulate-bearing gas stream comprising:

a) flowing a particulate-bearing gas stream in a first direction at a first volumetric flow rate to a plurality of electrostatic precipitator units;

b) passing at least a portion of the gas stream past at least one discharge electrode in each electrostatic precipitator so as to produce electrically charged particulate matter;

c) collecting the electrically charged particulate matter on at least one primary collection electrode plate, which is oppositely charged from the discharge electrode, until a desired amount of particulate matter has been collected;

d) reducing the flow through at least one of the electrostatic precipitator units;

e) sequentially increasing the flow through one or more remaining electrostatic precipitator units in an amount so as to maintain the sum of flow through all of the electrostatic precipitator units at the first volumetric flow rate;

f) subjecting the at least one primary collection electrode plate in the at least one electrostatic precipitator unit of step (d) with reduced flow to forces which dislodge the particulate matter from the at least one primary collection electrode;

g) collecting the dislodged particulate matter in a particulate collection receptacle; and h) withdrawing a gas stream of reduced particulate matter contamination, the method further comprising generating an electrical potential between the at least one primary collection electrode plate and the particulate collection receptacle to drive the particulate matter that is dislodged from the at least one primary collection electrode plate to the particulate collection receptacle, wherein the electrical charge in the particulate collecting receptacle is generated by means of a secondary collection electrode.

2. The method of claim 1, wherein at least 70% by weight of the particulate matter has a particle size diameter of less than 10 microns in diameter.

3. The method of claim 1, wherein at least 70% by weight of the particulate matter has a particle size diameter of less than 2.5 microns in diameter.

4. The method of claim 1, wherein the particulate matter is zeolite catalyst particles from the regeneration section of a fluid catalytic cracking unit in a petroleum refinery.

5. The method of claim 1, wherein the flow through the at least one electrostatic precipitator unit of step (d) is reduced by at least 50 vol. %.

6. The method of claim 1, wherein the flow through the at least one electrostatic precipitator unit of step (d) is reduced by at least 90 vol. %.

7. The method of claim 1, wherein the flow through the at least one electrostatic precipitator unit of step (d) is reduced by 100 vol. %.

8. The method of claim 1 further comprising flowing a secondary gas stream in a second direction to drive the particulate matter that is dislodged from the at least one primary collection electrode plate to the particulate collection receptacle.

9. The method of claim 8, wherein the secondary gas stream is flowed in a direction oblique to the flow direction of the particulate-bearing gas stream.

10. The method of claim 1, wherein the electrical potential is generated in the particulate collecting receptacle with a polarity that is equal to the polarity of the at least one primary collection electrode plate, and the polarity of the at least one primary collection electrode plate is reversed, such that the polarity of the at least one primary collection electrode plate is opposite in polarity to that of an electrical charge generated in the particulate collecting receptacle.

* * * * *